United States Patent [19]

Mifune et al.

[11] 4,166,742

[45] Sep. 4, 1979

[54] CONTRASTY LIGHT-SENSITIVE SILVER HALIDE MATERIAL CONTAINING A HYDRAZINE DERIVATIVE AND A HETEROCYCLIC MERCAPTAN

[75] Inventors: Hiroyuki Mifune; Shunji Takada; Yoshitaka Akimura; Tadao Shishido, all of Minami-ashigara, Japan

[73] Assignee: Fuji Photo Film Co., Ltd., Minami-ashigara, Japan

[21] Appl. No.: 841,855

[22] Filed: Oct. 13, 1977

[30] Foreign Application Priority Data

Oct. 18, 1976 [JP] Japan ..... 51-124621

[51] Int. Cl.[2] ..... G03C 1/28

[52] U.S. Cl. ..... 96/107; 96/109; 96/95; 96/67; 96/108

[58] Field of Search ..... 96/107, 109, 95, 66 R, 96/66.3, 66.5, 67, 108

[56] References Cited

U.S. PATENT DOCUMENTS

| | | | |
|---|---|---|---|
| 2,419,975 | 5/1947 | Trivelli et al. | 96/95 |
| 3,227,552 | 1/1966 | Whitmore | 96/3 |
| 3,386,831 | 6/1968 | Honig et al. | 96/109 |
| 3,793,027 | 2/1974 | Okutsu et al. | 96/66.5 |

OTHER PUBLICATIONS

Birr: "Stabilization of Photographic Silver Halide Emulsions", The Focal Press, pp. 180–183, 10–1975.

*Primary Examiner*—Won H. Louie, Jr.
*Attorney, Agent, or Firm*—Sughrue, Rothwell, Mion, Zinn and Macpeak

[57] ABSTRACT

A silver halide photographic light-sensitive material containing at least one negative image silver halide photographic emulsion layer comprising silver halide grains that have an average grain size of not more than about 0.7 $\mu$ and are substantially of the surface latent image type and containing a binder in an amount of not more than about 250 g per mol of silver halide, and containing a compound represented by the following general formula (I):

$$R^1NHNHCOR^2 \quad (I)$$

wherein $R^1$ represents an aryl group; and $R^2$ represents a hydrogen atom, a phenyl group or an unsubstituted alkyl group having 1 to 3 carbon atoms; in at least one of the hydrophilic colloid layers, and a compound represented by the following general formula (II) or (III):

(II)

(III)

wherein Y represents a sulfur atom, a selenium atom, an oxygen atom, a nitrogen atom or a divalent residue; —$NR^4$—, wherein $R^4$ represents a hydrogen atom, an alkyl group or an aryl group; Z represents an atomic group required for completing a 5- or 6-membered heterocyclic ring; $R^5$ and $R^6$, which may be the same or different, each represents a hydrogen atom, a halogen atom, a carboxy group, an alkoxycarbonyl group, an alkyl group, an aryl group, a hydroxy group, a mercapto group or an alkylthio group or $R^5$ and $R^6$ may combine and represent an atomic group required for forming a 5- or 6-membered ring; m is 0 or 1, m being 0 where Y represents a sulfur atom, a selenium atom or an oxygen atom; and $R^3$ represents a hydrogen atom, an alkylthiocarbonyl group or a moiety of the formula:

wherein Y, Z, $R^5$, $R^6$ and m are each as described above; in the same or a different hydrophilic colloid layer.

11 Claims, No Drawings

CONTRASTY LIGHT-SENSITIVE SILVER HALIDE MATERIAL CONTAINING A HYDRAZINE DERIVATIVE AND A HETEROCYCLIC MERCAPTAN

BACKGROUND OF THE INVENTION

1. Field of the Invention

This invention relates to silver halide photographic light-sensitive materials and, more particularly, to photographic light-sensitive materials providing extremely contrasty negative image photographic characteristics.

2. Description of the Prior Art

A method of obtaining photographic characteristics of a contrasty negative image by adding a hydrazine compound to a silver halide photographic emulsion is described in U.S. Pat. No. 2,419,975. U.S. Pat. No. 2,419,975 discloses that extremely contrasty photographic characteristics, such as a gamma (γ) of more than 10, can be obtained by adding a hydrazine compound to a silver chlorobromide emulsion and developing the emulsion with a developer having a pH as high as 12.8. However, strongly alkaline developers having a pH near 13 are so unstable that they tend to be oxidized by air and, therefore, cannot be used or stored for long periods of time. Moreover, development at such a high pH tends to cause fog.

Ultra-contrasty photographic characteristics, either of a negative image or of a positive image, are very useful for the photographic reproduction of an image of a continuous tone comprising a dot image which is useful in making printing plates or the reproduction of a line image. For the above purposes, hitherto a method of using a silver chlorobromide photographic emulsion having a silver chloride content of more than 50 mol%, preferably more than 75 mol%, and developing the emulsion with a hydroquinone developer having an extremely reduced effective concentration of sulfite ions (usually less than 0.1 mol/l) has been generally adopted. However, in this method, since the sulfite ion in the developer is in low concentration, the developer is very unstable and cannot withstand storage for a period exceeding 3 days. Furthermore, since a silver chlorobromide emulsion containing a relatively high percentage of silver chloride must be used, high sensitivity cannot be obtained.

Accordingly, use of an emulsion of high sensitivity and a stable developer to obtain ultra-contrasty photographic characteristics useful for the reproduction of a dot image or a line image have been strongly desired.

SUMMARY OF THE INVENTION

A first object of this invention is to provide silver halide photographic materials which can be processed with a stable developer to provide photographic characteristics of an extremely contrasty negative image.

A second object of this invention is to provide highly sensitive silver halide photographic light-sensitive materials which can provide photographic characteristics of an extremely contrasty negative image.

A third object of this invention is to provide silver halide photographic light-sensitive materials which can provide photographic characteristics of an extremely contrasty negative image with less fog being produced.

The above various objects of this invention are accomplished by using a silver halide photographic light-sensitive material containing at least one negative image silver halide photographic emulsion layer comprising silver halide grains which have an average grain size of not more than about 0.7μ and which are substantially of the surface latent image type and containing a binder in an amount of not more than about 250 g per mol of silver halide and in which a compound represented by the following general formula (I):

$$R^1NHNHCOR^2 \quad (I)$$

wherein $R^1$ represents an aryl group; and $R^2$ represents a hydrogen atom, a phenyl group or an unsubstituted alkyl group having 1 to 3 carbon atoms; is present in at least one of the hydrophilic colloid layers and a compound represented by the following general formula (II) or (III):

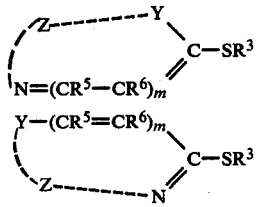

(II)

(III)

wherein Y represents a sulfur atom, a selenium atom, an oxygen atom, a nitrogen atom or a divalent residue: $—NR^4—$, wherein $R^4$ represents a hydrogen atom, an alkyl group or an aryl group; Z represents an atomic group required for completing a 5- or 6-membered heterocyclic ring; $R^5$ and $R^6$, which may be the same or different, each represents a hydrogen atom, a halogen atom, a carboxy group, an alkoxycarbonyl group, an alkyl group, an aryl group, a hydroxy group, a mercapto group or an alkylthio group or $R^5$ or $R^6$ may combine and represent an atomic group required for forming a 5- or 6-membered ring; m is 0 or 1, m being 0 where Y represents a sulfur atom, a selenium atom or an oxygen atom; and $R^3$ represents a hydrogen atom, an alkylthiocarbonyl group or a moiety of the formula:

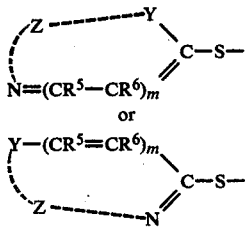

wherein Y, Z, $R^5$, $R^6$ and m are each as described above; is present in the same or a different hydrophilic colloid layer.

DETAILED DESCRIPTION OF THE INVENTION

In the general formula (I) above, $R^1$ represents a monocyclic or bicyclic aryl group. A suitable example of a monocyclic aryl group for $R^1$ is a phenyl group and a suitable example of a bicyclic aryl group for $R^1$ is a naphthyl group. The aryl group may be substituted with one or more substituents which are not electron-attracting, such as alkyl groups having 1 to 20 carbon atoms (which may be straight or branched chained, e.g., methyl, ethyl, propyl, isopropyl, n-butyl, isobutyl, n-octyl, n-hexyl, tert-octyl, n-decyl, n-dodecyl, etc.), aralkyl groups having 1 to 3 carbon atoms in the alkyl moiety thereof (e.g., benzyl, phenethyl, etc.), alkoxy groups having 1 to 20 carbon atoms (in which the alkyl moiety may be straight or branched chain, e.g., methoxy, ethoxy, 2-methylpropyoxy, etc.), amino groups which are mono- or disubstituted with alkyl groups having 1 to 20 carbon atoms, aliphatic acylamino groups having 2 to 21 carbon atoms or aromatic acylamino groups (e.g., acetylamino, octynylamino, benzoylamino, dimethylamino, etc.), etc.

$R^2$ represents a hydrogen atom, an alkyl group having 1 to 3 carbon atoms which may be straight or branched chained (e.g., methyl, ethyl, n-propyl and isopropyl) or a phenyl group. It is preferred for the alkyl group to be unsubstituted. The phenyl group may be substituted with one or more substituents which preferably are electron-attracting groups, such as a halogen atom (chlorine or bromine, etc.), a cyano group, a trifluoromethyl group, a carboxyl group or a sulfo group, etc.

Specific examples of suitable substituents represented by $R^1$ are a phenyl group, an α-naphthyl group, a β-naphthyl group, a p-tolyl group, an m-tolyl group, an o-tolyl group, a p-methoxyphenyl group, an m-methoxyphenyl group, a p-dimethylaminophenyl group, a p-diethylaminophenyl group, a p-(acetylamino)phenyl group, a p-(capryloylamino)phenyl group, a p-(benzoylamino)phenyl group and a p-benzylphenyl group.

Specific examples of suitable substituents represented by $R^2$, other than a hydrogen atom, are a methyl group, an ethyl group, an n-propyl group, an isopropyl group, a phenyl group, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group and a 2,5-dichlorophenyl group.

The substituent represented by $R^1$ is preferably a monocyclic aryl group, and particularly preferred are an unsubstituted phenyl group and a tolyl group.

The substituent represented by $R^2$ is preferably a hydrogen atom, a methyl group or a phenyl group which may be substituted. A hydrogen atom is particularly preferred for $R^2$.

In the above general formulas (II) and (III), Y represents a sulfur atom, a selenium atom, an oxygen atom, a nitrogen atom or a divalent residue: —$NR^4$—. $R^4$ represents a hydrogen atom, an alkyl group or an aryl group. Z represents an atomic group required for completing a 5- or 6-membered heterocyclic ring. $R^5$ and $R^6$, which may be the same or different, each represents a hydrogen atom, a halogen atom (such as a chlorine atom, a bromine atom, etc.), a carboxy group, an alkoxycarbonyl group, an alkyl group, an aryl group, a hydroxy group, a mercapto group or an alkylthio group or $R^5$ and $R^6$ may combine and represent an atomic group required for forming a 5-membered or 6-membered ring. m is 0 or 1, with m being 0 where Y represents a sulfur atom, a selenium atom or an oxygen atom. $R^3$ represents a hydrogen atom, an alkylthiocarbonyl group, an alkoxycarbonyl group, an aryloxycarbonyl group, an alkoxycarbonylmethyl group, an aryloxycarbonylmethyl group or a moiety of the formula:

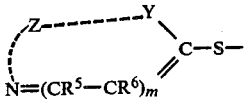

or

-continued

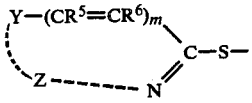

wherein Y, Z, $R^5$, $R^6$ and m are as described above.

Examples of suitable 5- or 6-membered heterocyclic rings completed by Z are those containing one or more hetero atoms such as a sulfur atom, a nitrogen atom, an oxygen atom or a selenium atom, preferably a sulfur atom, a nitrogen atom or an oxygen atom. Specific examples of heterocyclic rings completed by Z include a thiazole ring, a selenazole ring, an oxazole ring, an imidazole ring, a pyrazole ring, a 1,3,4-thiadiazole ring, a 1,3,4-oxadiazole ring, a 1,2,4-thiadiazole ring, a 1,3,4-triazole ring, a tetrazole ring, a pyrimidine ring, a 1,3,5-triazine ring and a 1,2,3-triazine ring. These heterocyclic rings, of course, include those which are condensed with a 5- to 7-membered carbon ring or heterocyclic ring. That is, the thiazole ring includes, e.g., a benzothiazle nucleus, a naphthothiazole nucleus, a dihydronaphthothiazole nucleus, a tetrahydrobenzothiazole nucleus, etc. The selenazole ring includes, e.g., a benzoselenazole nucleus, etc. The oxazole ring includes, e.g., a benzoxazole nucleus, a naphthoxazole nucleus, etc. The imidazole ring includes, e.g., a benzimidazole nucleus, an imidazolopyrimidine nucleus, etc. The triazole ring includes, e.g., a triazolopyridine nucleus, a triazolopyrimidine nucleus, etc. The pyrazole ring includes, e.g., a pyrazolopyridine nucleus, a pyrazolopyrimidine nucleus, etc. The pyrimidine ring includes, e.g., a pyrazolopyrimidine nucleus, a pyrrolopyrimidine nucleus, a triazolopyrimidine nucleus, etc.

The carbon atoms of these heterocyclic rings can contain various substituents. Examples of suitable substituents are an alkyl group having 1 to 20 carbon atoms (such as a methyl group, an ethyl group, an n-butyl group, a t-butyl group, a heptyl group or a heptadecyl group), an alkoxy group having 1 to 20 carbon atoms (such as methoxy group, an ethoxy group, a dodecyloxy group or a heptadecyloxy group), an alkylthio group having 1 to 20 carbon atoms (such as a methylthio group, an ethylthio·group or a butylthio group), a hydroxy group, a mercapto group, an amino group (which may be unsubstituted or substituted, e.g., an alkyl-substituted amino group such as a dimethylamino group, a methylamino group, a diethylamino group, a butylamino group or a benzylamino group; an aryl-substituted amino group such as an anilino group or a diphenylamino group; an acylamino group such as an acetylamino group, a capryloylamino group, a benzoylamino group, a methylsulfonylamino group, a benzenesulfonylamino group or a p-toluenesulfonylamino group; a thioamido group such as an acetylthioamido group or a propionylthioamido group; etc.), an aryl group (such as a phenyl group, a naphthyl group or a tolyl group), an alkenyl group having 2 to 20 carbon atoms (such as an allyl group or a methallyl group), an aralkyl group having an alkyl moiety with 1 to 4 carbon atoms (such as a benzyl group or a phenethyl group), a halogen atom (such as a chlorine atom or a bromine atom), a cyano group, a carboxyl group, a sulfo group, a carbamoyl group (which may be substituted, e.g., a carbamoyl group, a methylcarbamoyl group, a dimethylcarbamoyl group, an ethylcarbamoyl group, a phenylcarbamoyl group, etc.), a thiocarbamoyl group (which may be substituted, e.g., a thiocarbamoyl group, a methylthiocarbamoyl group, a dimethylthiocarbamoyl group, an ethylthiocarbamoyl group, a phenylthiocarbamoyl group, etc.), an alkoxycarbonyl group having 2 to 22 carbon atoms (such as a methoxycarbonyl group, an ethoxycarbonyl group or a butoxycarbonyl group), an aryloxycarbonyl group (such as a phenoxycarbonyl group), an alkylcarbonyl group having 2 to 22 carbon atoms (such as an acetyl group or a capryloyl group) and an oxygen atom. The above-described alkyl group may be further substituted with one or more of a carboxy group, a sulfo group, an alkoxycarbonyl group (such as a methoxycarbonyl group or an ethoxycarbonyl group), an acyloxy group (such as an acetoxy group), an aryl group (e.g., an unsubstituted or substituted phenyl group such as a nitrophenyl group), etc.

The substitutable nitrogen atom of the above-described heterocyclic rings can be substituted with substituents as described above for $R^4$.

Where Y represents —$NR^4$—, the alkyl group represented by $R^4$ has 1 to 20 carbon atoms, and includes unsubstituted and substituted alkyl groups. The alkyl group may be substituted with one or more of the following substituents, e.g., a halogen atom, a cyano group, a carboxy group, a sulfo group, a sulfato group, a phospho group, a carbamoyl group, an aminosulfonyl group, a hydroxy group, an alkoxy group having 1 to 20 carbon atoms [e.g., a methoxy group, an ethoxy group, a propoxy group, a butoxy group; an alkoxy group substituted with, e.g., a hydroxy group, an alkoxy group having 1 to 6 carbon atoms (such as a methoxy group, an ethoxy group or a propoxy group), an acyloxy group having 2 to 8 carbon atoms (such as an acetoxy group or a propionyloxy group), a sulfo group, a sulfoalkoxy group having 1 to 6 carbon atoms (such as a 2-sulfoethoxy group or a 3-sulfopropoxy group), etc.], an acyloxy group having 2 to 22 carbon atoms (such as an acetoxy group or a propionyloxy group), an alkenyl group having 2 to 22 carbon atoms (such as a vinyl group), an alkoxycarbonyl group having 2 to 22 carbon atoms (such as a methoxycarbonyl group, an ethoxycarbonyl group, a butoxycarbonyl group or a dodecyloxycarbonyl group), an aryl group (which can be monocyclic or bicyclic and may be unsubstituted or substituted, e.g., a phenyl group, a p-sulfophenyl group, etc.), a heterocyclic ring residue (such as a thiazole ring residue, an oxazole ring residue, an imidazole ring residue, a thiadiazole ring residue, an oxadiazole ring residue, a triazole ring residue, a tetrazole ring residue or a pyrimidine ring residue, the group:

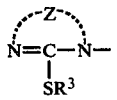

being particularly advantageous), etc.

Specific examples of alkyl group represented by $R^4$ are as follows: a methyl group, an ethyl group, an n- or i-propyl group, an n-, sec, i- or t-butyl group, an n-hexyl group, a dodecyl group, a heptadecyl group, a chloromethyl group, a 2-chloroethyl group, a 2-cyanoethyl group, a carboxymethyl group, a 2-carboxyethyl group, a 2-sulfoethyl group, a 3-sulfopropyl group, a 3-sulfobutyl group, a 4-sulfobutyl group, a 2-sulfatoethyl group, a 2-phosphoethyl group, a 2-hydroxyethyl group, a 3-hydroxypropyl group, a 2-methoxyethyl group, a 3-methoxypropyl group, a 2-ethoxyethyl group, a 2-(2-hydroxyethoxy)ethyl group, a 2-(2-acetoxyethoxy)ethyl group, a 2-(2-sulfoethoxy)ethyl group, a 2-[2-(3-sulfopropoxy)ethoxy]ethyl group, a 2-acetoxyethyl group, a 4-propionyloxybutyl group, an allyl group, a methoxycarbonylmethyl group, a 2-(methoxycarbonyl-)ethyl group, a 4-(ethoxycarbonyl)butyl group, a butoxycarbonylmethyl group, a benzyl group, a 2-phenylethyl group, a p-sulfobenzyl group and a 2-(2-mercapto-3-benzimidazolyl)ethyl group.

The alkyl groups represented by $R^5$ and $R^6$ respectively have 1 to 20 carbon atoms and include unsubstituted and substituted alkyl groups. Examples of suitable substituents which the alkyl groups may have are a halogen atom (such as a chlorine atom), a cyano group, a carboxy group, a hydroxy group, an acyloxy group having 2 to 6 carbon atoms (such as an acetoxy group), an alkoxycarbonyl group having 2 to 22 carbon atoms (such as an ethoxycarbonyl group or a butoxycarbonyl group) and an aryl group (which can be monocyclic or bicyclic and may be unsubstituted or substituted, e.g., a phenyl group, a tolyl group, a p-sulfophenyl group, etc.). Examples of advantageous alkyl groups are as follows: a methyl group, an ethyl group, an n- or i-propyl group, an n-, i- or t-butyl group, an amyl group (which may be straight or branched chain, hereinafter the same), a hexyl group, an octyl group, a dodecyl group, a pentadecyl group, a heptadecyl group, a chloromethyl group, a 2-chloroethyl group, a 2-cyanoethyl group, a carboxymethyl group, a 2-carboxyethyl group, a 2-hydroxyethyl group, a 2-acetoxyethyl group, an acetoxymethyl group, an ethoxycarbonylmethyl group, a butoxycarbonylmethyl group, a 2-methoxycarbonylethyl group, a benzyl group, an o-nitrobenzyl group and a p-sulfobenzyl group.

The aryl groups represented by $R^4$, $R^5$ and $R^6$ respectively can be monocyclic or bicyclic, preferably monocyclic, and include both unsubstituted and substituted aryl groups. Examples of suitable substituents for the aryl groups are an alkyl group having 1 to 20 carbon atoms (such as a methyl group, an ethyl group or a nonyl group), an alkoxy group having 1 to 20 carbon atoms (such as a methoxy group or an ethoxy group), a hydroxy group, a halogen atom (such as a chlorine atom or a bromine atom), a carboxy group and a sulfo group. Specific examples of aryl groups are a phenyl group, a p-tolyl group, a p-methoxyphenyl group, a p-hydroxyphenyl group, a p-chlorophenyl group, a 2,5-dichlorophenyl group, a p-carboxyphenyl group, an o-carboxyphenyl group, a 4-sulfophenyl group, a 2,4-disulfophenyl group, a 2,5-disulfophenyl group, a 3-sulfophenyl group and a 3,5-disulfophenyl group.

The alkoxycarbonyl groups represented by $R^5$ and $R^6$ respectively have, preferably, 2 to 22 carbon atoms. Specific examples of suitable alkoxycarbonyl groups include a methoxycarbonyl group, an ethoxycarbonyl group, a butoxycarbonyl group, etc. The alkylthio groups represented by $R^5$ and $R^6$ respectively have an alkyl moiety with 1 to 6 carbon atoms, preferably 1 to 3 carbon atoms. Specific examples of suitable alkylthio groups include a methylthio group, an ethylthio group, a butylthio group, etc. The alkyl moiety of both the alkoxycarbonyl group and the alkylthio group may be unsubstituted or substituted.

The 5- or 6-membered ring formed by $R^5$ and $R^6$ can be, e.g., a carbocyclic ring such as a benzene ring, a cyclohexane ring, etc., or a heterocyclic ring containing a hetero atom, e.g., a nitrogen atom, such as a pyridine ring, a pyrimidine ring, a pyrrole ring, a pyrazole ring, an imidazole ring, a triazole ring, etc. A pyrazole ring, an imidazole ring and a triazole ring are preferred.

The alkylthiocarbonyl group represented by $R^3$ has, preferably, 2 to 6 carbon atoms. Suitable examples of alkylthiocarbonyl groups for $R^3$ are groups such as an ethylthiocarbonyl group, etc. Suitable examples of alkoxycarbonyl groups for $R^3$ include groups such as a methoxycarbonyl group, an ethoxycarbonyl group, a butoxycarbonyl group, etc., suitable examples of alkoxycarbonylmethyl groups for $R^3$ include groups such as an ethoxycarbonylmethyl group, etc., and suitable examples of aryloxycarbonylmethyl groups for $R^3$ include groups such as a phenoxycarbonylmethyl group, etc. The alkyl moiety thereof may be unsubstituted or substituted.

The bond between Y and Z in the general formulas set forth above is presented schematically and may be single bond or double bond, depending on what Y represents. More specifically, when Y represents a sulfur atom, a selenium atom, an oxygen atom or an —$NR^4$— group, the bond between Y and Z is a single bond, and when Y represents a nitrogen atom, the bond between Y and Z is a double bond.

Silver halide grains having an average grain size of not more than about 0.7μ which are present in the silver halide emulsion layer containing a binder in an amount of not more than about 250 g per mol of silver halide in this invention are substantially the surface latent image type. In other words, they are not substantially the internal latent image type. The expression "substantially surface latent image type" as used in this specification means that the sensitivity obtained by (A) surface development is higher than that obtained by (B) internal development when development is carried out by (A) a surface development method and (B) an internal development method described below after exposure to light for 1 to 1/100 second. The sensitivity as used herein is defined as follows:

$$S=100/Eh$$

wherein S is the sensitivity, and Eh is the exposure amount required to obtain a density just intermediate between the maximum density (Dmax) and the minimum density (Dmin), i.e., $\frac{1}{2}$(Dmax+Dmin).

(A) Surface Development

Development is carried out at a temperature of 20° C. for 10 minutes in a developer of the following formulation.

N-Methyl-p-aminophenol (hemisulfate): 2.5 g
Ascorbic Acid: 10 g
Sodium Metaborate (tetrahydrate): 35 g
Potassium Bromide: 1 g
Water to make: 1 l (B) Internal Development After treatment at about 20° C. for 10 minutes in a bleaching solution containing 3 g/l of ferricyanide and 0.0125 g/l of phenosafranine and then washing for 10 minutes, development is carried out at 20° C. for 10 minutes in a developer of the following formulation.

N-Methyl-p-aminophenol (hemisulfate): 2.5 g
Ascorbic Acid: 10 g
Sodium Metaborate (tetrahydrate): 35 g
Potassium Bromide: 1 g
Sodium Thiosulfate: 3 g
Water to make: 1 l If the emulsion used in this invention is not substantially the surface latent image type, a positive image is obtained in addition to a negative image.

The average grain size of the silver halide grains that are substantially the surface latent image type which are present in the silver halide emulsion layer having a binder in an amount of not more than about 250 g per mol of silver halide must not be more than about 0.7μ. The term "average grain size" is commonly used by those skilled in the art of silver halide photography and is well understood. The term "grain size" means the diameter of the grains when the grains are spherical or approximate spheres. With cubic grains, the grain size refers to the length of an edge$=\sqrt{4/\pi}$. The average grain size is determined in terms of the algebraic average or geometric average based on the projected area of the grains. The details of the measurment of the average grain size is described in C. E. K. Mees & T. H. James, *The Theory of the Photographic Process,* 3rd Ed., pp. 36–43, Macmillan, New York (1966).

If the average grain size of the silver halide grains in the photographic emulsion layer which the light-sensitive material of this invention indispensably has exceeds about 0.7μ, a very high contrast (e.g., more than 8 as expressed by γ) cannot be obtained using a stable developer containing sulfite ions in a concentration of more than about 0.15 mol/l. The average grain size of the emulsion of this invention is preferably not more than 0.4μ. Although the average grain size is small, the light-sensitive material of this invention has high sensitivity characteristics.

The silver halide present in the photographic emulsion which is used in this invention may be any of silver chloride, silver bromide, silver chlorobromide, silver iodobromide and silver iodochlorobromide. For silver iodobromide or silver iodochlorobromide, the content of silver iodide is preferably not more than about 10 mol%, and particularly preferably is 6 mol% or less. According to this invention, silver bromide, silver iodobromide or silver chlorobromide (or silver iodochlorobromide) containing a high percentage of silver bromide can also be used, and, therefore, high sensitivity can more easily be obtained as compared with the method in which a conventional lith-type ultra-contrasty light-sensitive material is used. Where silver chloride is used, the content of silver chloride is preferably not more than about 80 mol% of the total silver halide and, particularly preferably is not more than 50 mol%.

The photographic emulsion layers which have an average grain size of not more than about 0.7μ and are substantially the surface latent image type, of which, at least one, is present in the light-sensitive material of this invention, must not contain a binder in an amount of more than about 250 g per mol of silver halide. A suitable amount of the binder can range from about 20 g to about 250 g per mol of silver halide. If the binder content is more than about 250 g per mol of silver halide, it is impossible to provide contrasty photographic chracteristics, and particularly, to provide extremely contrasty photographic characteristics which is an object of this invention.

The general tendency of photographic emulsions is that the smaller is the amount of a binder present in the emulsion, the higher is the contrast which is obtained. This effect is due to an increase in the amount of silver halide present in the emulsion layer of a unit thickness. The influence of the silver halide content in this invention differs from such known effect, and the effect on the image remarkably changes in the vicinity of the above-described upper limit. The effect of this invention can be produced only when the average grain size is not more than about 0.7μ and the emulsion contains a high percentage of silver halide, as described above.

Gelatin is advantageously used as a binder or protective colloid in the photographic emulsion, but other hydrophilic colloids can also be used. For example, gelatin derivatives, graft polymers of gelatin with other high molecular weight materials, proteins such as albumin or casein, cellulose derivatives such as hydroxyethyl cellulose, carboxymethyl cellulose or cellulose sulfate, saccharide derivatives such as sodium alginate or starch derivatives, various synthetic hydrophilic high molceular weight materials such as homopolymers or copolymers, e.g., polyvinyl alcohol, polyvinyl alcohol (partial acetal), poly-N-vinyl pyrrolidone, polyacrylic acid, polymethacrylic acid, polyacrylamide, polyvinyl imidazole, polyvinyl pyrazole, etc., can be used.

Lime-processed gelatin and acid-processed gelatin can be used as the gelatin. Also, gelatin which is hydrolyzed or decomposed by enzymes can be used. Suitable gelatin derivatives are those which are prepared by reacting gelatin with various compounds such as acid halides, acid anhydrides, isocyanates, bromoacetic acid, alkanesultones, vinylsulfonamides, maleinimide compounds, polyalkylene oxides or epoxy compounds. Specific examples of these gelatin derivatives are described in, e.g., U.S. Pat. Nos. 2,614,928, 3,132,945, 3,186,846 and 3,312,553, British Pat. Nos. 861,414, 1,033,189 and 1,005,784, Japanese Patent Publication No. 26,845/67, etc.

Examples of gelatin graft polymers include those prepared by grafting a homopolymer or a copolymer of a vinylic monomer such as acrylic acid, methacrylic acid, the derivatives thereof (such as the esters or the amides thereof), acrylonitrile or styrene to gelatin. In particular, graft polymers prepared from polymers which are compatible with gelatin to some degree, such as those of acrylic acid, methacrylic acid, acrylamide, methacrylamide or hydroxyalkyl methacrylate are preferred. Examples of these polymers are described in, e.g., U.S. Pat. Nos. 2,763,625, 2,831,767 and 2,956,884, etc. Typical synthetic hydrophilic high molecular weight materials are described in, e.g., German Patent Application (OLS) No. 2,312,708, U.S. Pat. Nos. 3,620,751 and 3,879,205, Japanese Patent Publication No. 7,561/68, etc.

The photographic light-sensitive material of this invention must conain at least one of the photographic emulsion layers having the above-described characteristics, but if desired, one or more other types of silver halide photographic emulsion layers can be present. As to the latter emulsion layers, the average grain size of the silver halide may be more than about 0.7μ and also a binder may be present in an amount of more than about 250 g per mol of silver halide. Moreover, the emulsion layers may have been chemically sensitized using known techniques. The mutual relationship of the arrangement between the photographic emulsion layer which meets the requirements of this invention and the other emulsion layers is not particularly restricted, and either of them may be positioned nearer the support. However, in order to satisfactorily produce the effect of this invention, it is preferred for all of the photographic emulsion layers to be silver halide emuslions of the negative image type, i.e., negative image silver halide emulsions which satisfy the requirements of this invention as to the average grain size, the binder content and the distribution of the latent image.

Although the silver halide emulsions used in the present invention need not necessarily be chemically sensitized, chemically sensitized silver halide emulsions are preferred. Processes for chemical sensitization of the silver halide emulsions which can be used include known sulfur sensitization, reduction sensitization and noble metal sensitization processes. These processes are described in references such as P. Glafkides, *Chimie et Phisique Photographique,* Paul Montel, Paris (1967) or Zelikmann, *Making and Coating Photographic Emulsions,* The Focal Press, London (1964) or H. Frieser, *Die Gründlagen der photographischen Prozesse mit Silberhalogeniden,* Akademische Verlagsgesellschaft (1968). In the noble metal sensitization processes, a gold sensitization process is a typical process where gold compounds or mainly gold complexes are used. However, if the gold sensitizing agents are used in an amount effective to carry out chemical sensitization, a softening of the tone occurs. Accordingly, gold sensitization is not as suitable for the present invention. No difficulties occur using complexes of noble metals other than gold, such as those of platinum, palladium or iridium, etc. A reduction sensitization process may be used if the process does not generate a fog which causes practical difficulties. However, reduction sensitization is not as preferred because control of the process conditions is difficult. A preferred chemical sensitization process for the present invention is the use of a sulfur sensitization process. In the present invention, it is preferred for the silver halide emulsions substantially not to be subjected to gold sensitization and it is particularly preferred for the silver halide emulsions to be chemically sensitized using only a sulfur sensitization process.

Examples of sulfur sensitizing agents which can be used include not only sulfur compounds present in the gelatin per se but also various sulfur compounds such as thiosulfates, thioureas, thiazoles or rhodanines, etc. Examples of suitable sulfur compounds are described in U.S. Pat. Nos. 1,574,944, 2,410,689, 2,278,947, 2,728,668 and 3,656,955. Typical examples of reduction sensitizing agents which can be used include stannous salts, amines, formamidine sulfinic acid and silane compounds, etc., as described in U.S. Pat. Nos. 2,487,850, 2,518,698, 2,983,609, 2,983,610 and 2,694,637. Complex salts of Group VIII metals in the Periodic Table, such as platinum, iridium or palladium, etc., can be used for noble metal sensitization and examples thereof are described in U.S. Patent 2,448,060 and British Patent 618,061, etc.

Of the compounds represented by the above-described general formula (I), preferred are compounds represented by the following general formula (Ia):

$$R^1NHNHCHO \qquad \text{(Ia)}$$

In the above formula, $R^1$ has the same meanings as in the above-described general formula (I).

Of the compounds of the above general formula (Ia), compounds represented by the following general formula (Ib) are preferred.

$$R^{11}NHNHCHO \qquad \text{(Ib)}$$

In the above formula, $R^{11}$ represents an unsubstituted phenyl group or a tolyl group.

Specific examples of the compounds represented by the general formula (I) are given below, but this invention is not to be construed as being limited thereto.

(I-1)

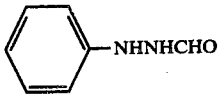

(I-2)

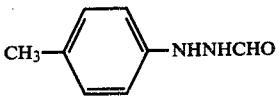

(I-3)

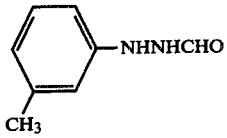

(I-4)

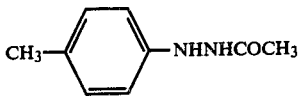

(I-5)

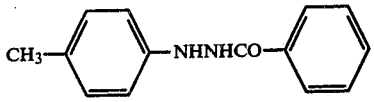

(I-6)

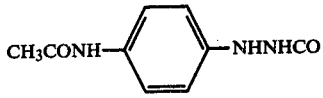

(I-7)

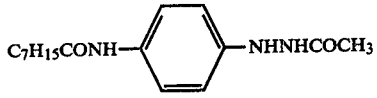

(I-8)

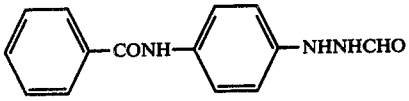

(I-9)

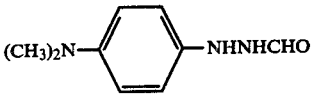

(I-10)

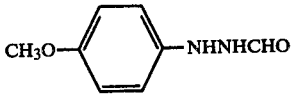

(I-11)

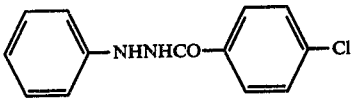

(I-12)

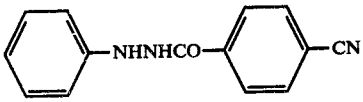

(I-13)

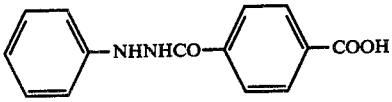

(I-14)

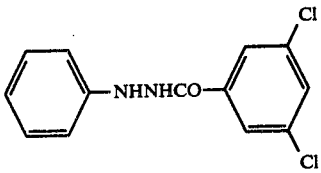

-continued (I-15)

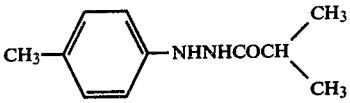

(I-16)

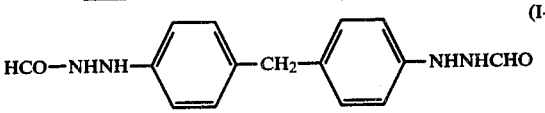

The compounds represented by the general formula (I) can be synthesized by reacting hydrazines with formic acid or by reacting hydrazines with acyl halides. Starting material hydrazines such as

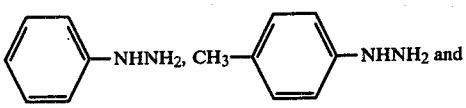

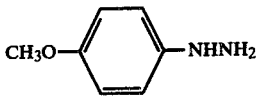

are commercially available and hydrazines of the formula

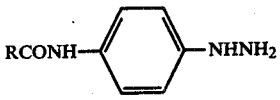

where R represents an alkyl group can be synthesized by reduction of a p-nitrophenylhydrazine. Suitable acyl halides which can be used include aliphatic acyl halides such as acetyl chloride, propionyl chloride, butyryl chloride, etc., and aromatic acyl halides such as benzoyl chloride, toluoyl chloride, etc. The reaction can be conducted in a solvent such as benzene, chloroform, pyridine, triethylamine, etc., and at a temperature of about 0° C. to about 100° C., preferably 0° C. to 70° C. A suitable molar ratio of the hydrazine to the acyl halide in the presence of a base such as pyridine or triethylamine which acts as a hydrogen halide acceptor for the hydrogen halide formed as a by-product ranges from about 1:1 to about 1:3, preferably 1:1.2 to 1:1.5 and in the absence of such a base ranges from about 1:0.3 to about 1:1, preferably 1:0.45 to 1:0.5. Hydrogen halide accepting agents such as triethylamine and pyridine can be employed in an amount of about 1 mol or more per mol of the acyl halide used.

Specific examples of the synthesis of the compounds of the general formula (I) are set forth below. Unless otherwise indicated herein, all parts, percents, ratios and the like are by weight.

Synthesis Example I

(Synthesis of Compound (I-2))

110 g of formic acid was stirred at 25° to 30° C., and to this, 107 g of p-tolylhydrazine was gradually added. After completing the addition, heating was performed at 50° C. for 20 minutes while stirring the mixture. After cooling the mixture with ice, the resulting crystals were filtered out and recrystallized from 550 ml of acetonitrile to obtain 54.5 g of colorless needles having a melting point of 176° to 177° C.

Synthesis Example II (Synthesis of Compound (I-5))

15 g of p-tolylhydrazine was added to 100 ml of acetonitrile at 25° to 30° C. while stirring. Then, 15 g of benzoyl chloride was added dropwise at 25° to 30° C. After completing the addition, stirring was continued at 25° to 30° C. for 6 hours. After cooling the mixture with ice, the resulting crystals were filtered out and then recrystallized from benzene to obtain 7 g of colorless needles having a melting point of 146° C.

In order to incorporate the compound of the general formula (I) in the photographic light-sensitive material, the compound may be added to the photographic emulsion of the surface latent image type which is employed in this invention or may be added to another emulsion layer(s) or non-light-sensitive layer(s) (such as a protective layer, an intermediate layer or an antihalation layer). Moreover, the photographic light-sensitive material after production can be treated in a bath containing the above compound of the general formula (I). However, the compound of the general formula (I) is, most preferably, added to the photographic emulsion of the surface latent image type which is employed in this invention. It is secondarily preferred to add the compound of the general formula (I) to the coating composition for a non-light-sensitive layer.

When the compound of the general formula (I) is added to the silver halide emulsion of the surface latent image type which is employed in this invention, the compound of the general formula (I) may be added at any of the stages during the preparation of the emulsion, but it is preferred to add it after the chemical ripening is substantially completed. When the compound of the general formula (I) is added during stages from the formation of the silver halide grains to chemical ripening, there is the possibility a silver halide emulsion of the internal latent image type will be formed or a negative image will not be obtained.

The compound of the general formula (I) is usually employed in the photographic light-sensitive material in an amount of about $10^{-4}$ to about $10^{-1}$ mol/mol Ag based on the silver halide grains of the surface latent image type which are present in the same area. Amounts ranging from $10^{-3}$ to $5\times10^{-2}$ mol/mol Ag, particularly $5\times10^{-3}$ to $5\times10^{-2}$ mol/mol Ag, are preferred. Usual techniques employed for adding additives to photographic emulsions can be used for adding the compound of the general formula (I) to the emulsion. For example, an aqueous solution with a suitable concentration of a water-soluble compound is produced. A compound which is insoluble or slightly soluble in water is dissolved in a suitable water-miscible organic solvent that has no adverse effects on photographic characteristics. Suitable solvents can be selected from, e.g., alcohols, ethers, glycols, acetones, esters, amides, etc. The thus-prepared solution is added to the emulsion. Also, the well-known method used for adding a water-insoluble coupler (a so-called oil-soluble coupler) as a dispersion to the emulsion can be employed. The same methods can also be employed in the addition to a coating composition for a non-light-sensitive layer.

In the compounds represented by the above-described general formula (II) or (III), the heterocyclic ring completed by Z is preferably a thiazole ring, an oxazole ring, an imidazole ring, a 1,3,4-thiadiazole ring, a 1,3,4-oxadiazole ring, a 1,3,4-triazole ring, a tetrazole ring, a pyrimidine ring or a 1,3,5-triazine ring. The condensed heterocyclic nucleus containing the above ring is advantageously a benzothiazole nucleus, a naphthothiazole nucleus, a benzoxazole nucleus, a benzimidazole nucleus, an imidazolopyrimidine nucleus, a triazolopyrimidine nucleus, etc.

Of the compounds represented by the general formula (II) or (III), advantageous compounds are those represented by the following general formulas (IV-a) to (IV-p).

(IV-a)

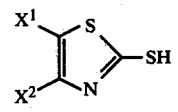

(IV-b)

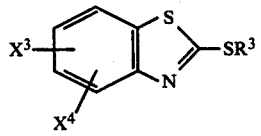

(IV-c)

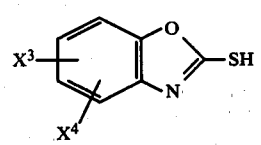

(IV-d)

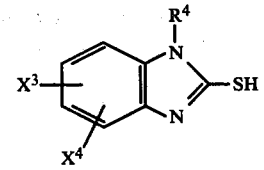

(IV-e)

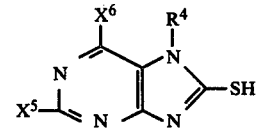

(IV-f)

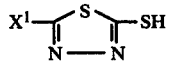

(IV-g)

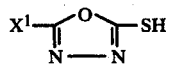

(IV-h)

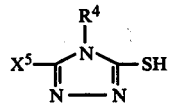

(IV-i)

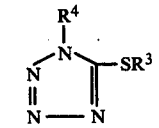

(IV-j)

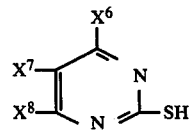

(IV-k)*

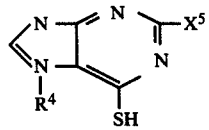

(IV-l)

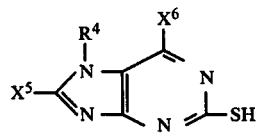

-continued

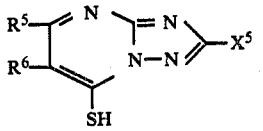

(IV-m)*

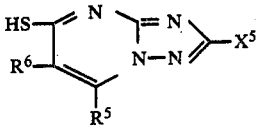

(IV-n)

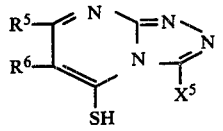

(IV-o)*

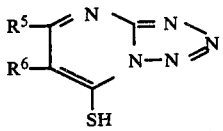

(IV-p)*

*General Formula (II) compounds; remainder General Formula (III) compounds

In the above general formulas (IV-a) to (IV-p), $R^3$, $R^4$, $R^5$ and $R^6$ each has the same meaning as in the general formula (II). $X^1$ and $X^2$, which may be the same or different, each represents a hydrogen atom, an alkyl group, an alkoxy group, a hydroxy group, an alkylthio group, a mercapto group, an aryl group, a halogen atom, an alkoxycarbonyl group or an aryloxycarbonyl group; $X^3$ and $X^4$, which may be the same or different, each represents a hydrogen atom, an alkyl group, an alkoxy group, a hydroxy group, a halogen atom, an alkoxycarbonyl group, an aryloxycarbonyl group, an alkyl-substituted amino group, an aryl-substituted amino group, an acyl-substituted amino group, a cyano group or a carbamoyl group; and $X^5$, $X^6$, $X^7$ and $X^8$, which may be the same or different, each represents a hydrogen atom, an alkyl group, an alkoxy group, a hydroxy group, an alkylthio group, a mercapto group, an aryl group, an alkoxycarbonyl group, an aryloxycarbonyl group, an alkyl-substituted amino group, an aryl-substituted amino group, an acyl-substituted amino group, an amino group, an alkenyl group or a carboxyl group, i.e., corresponding to a hydrogen atom or the substituents which can be present on a carbon atom of the heterocyclic nucleus completed by Z in the formulas (II) and (III).

$X^1$ and $X^2$ each preferably represents a hydrogen atom, an alkyl group, an alkoxy group, a hydroxy group, an alkylthio group, a mercapto group, an aryl group (particularly a phenyl group), a halogen atom or an alkoxycarbonyl group.

$X^3$ and $X^4$ each preferably represents a hydrogen atom, an alkyl group, an alkoxy group, a hydroxy group, an alkyl-substituted amino group, an acylamino group, a halogen atom, a cyano group, a carbamoyl group or an alkoxycarbonyl group.

$X^5$, $X^6$, $X^7$ and $X^8$ each preferably represents a hydrogen atom, an alkyl group, an alkoxy group, an alkylthio group, a hydroxy group, a mercapto group, an amino group, an alkylamino group, a dialkylamino group, an acylamino group, an aryl group, an alkenyl group, a carboxy group or an alkoxycarbonyl group.

In the above formulas (IV-m), (IV-n), (IV-o) and (IV-p), $R^5$ and $R^6$ each preferably represents a hydrogen atom, an alkyl group having 1 to 6 carbon atoms, an alkoxycarbonyl group having 2 to 5 carbon atoms or a halogen atom.

Among these compounds, those represented by the formula (IV-f) are particularly preferred.

Specific examples of the compounds represented by the general formula (II) or (III) are shown below. However, the present invention is not to be construed as being limited to these examples.

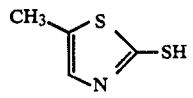

(III-1)

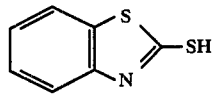

(III-2)

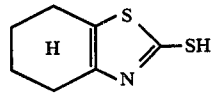

(III-3)

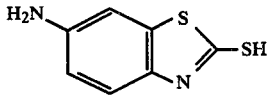

(III-4)

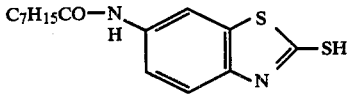

(III-5)

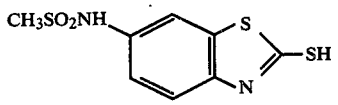

(III-6)

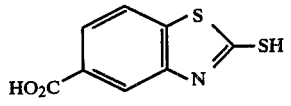

(III-7)

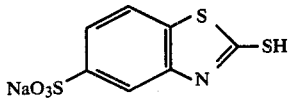

(III-8)

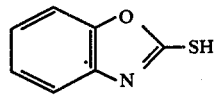

(III-9)

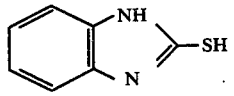

(III-10)

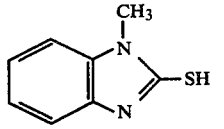

(III-11)

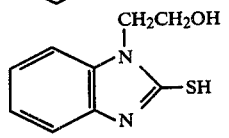

(III-12)

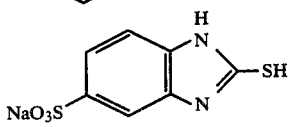

(III-13)

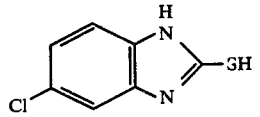

(III-14)

-continued
(III-15)
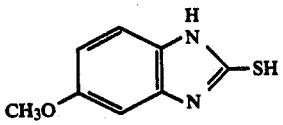
(III-16)
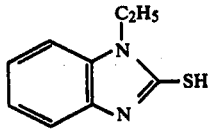
(III-17)
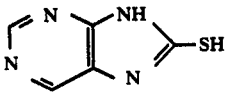
(III-18)
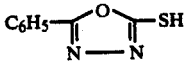
(III-19)
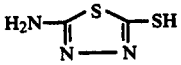
(III-20)
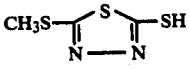
(III-21)
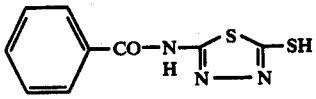
(III-22)
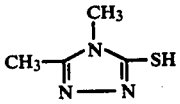
(III-23)
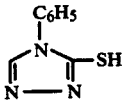
(III-24)
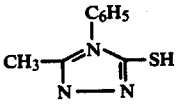
(III-25)
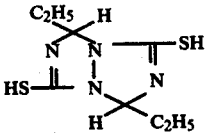
(III-26)
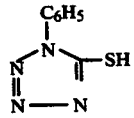
(III-27)
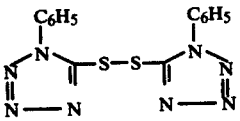
(III-28)
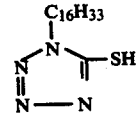
(III-29)
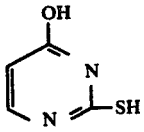
(III-30)
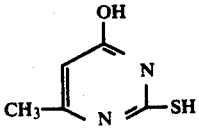
-continued
(III-31)
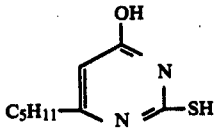
(III-32)
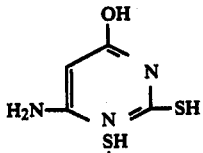
(III-33)
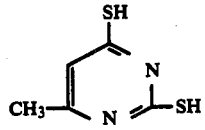
(III-34)
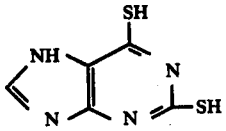
(III-35)
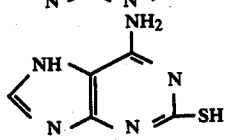
(II-1)
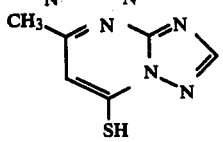
(II-2)
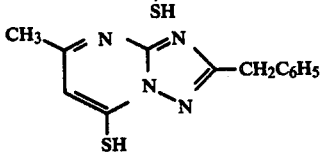
(II-3)
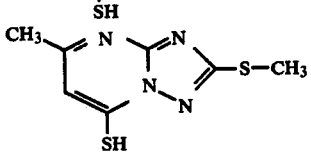
(III-36)
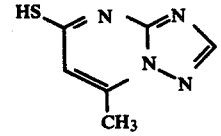
(II-4)
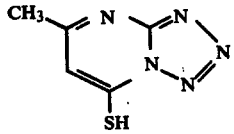
(III-37)
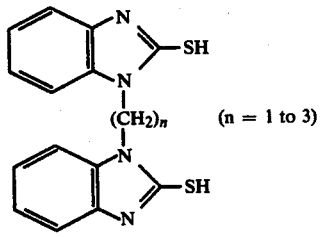
(n = 1 to 3)
(III-38)
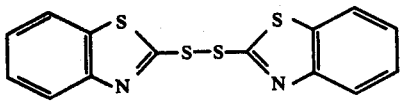
(III-39)
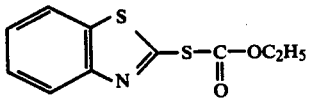

-continued (III-40)

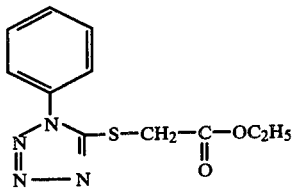

Some compounds of the general formulas (II) and (III), e.g., compounds (III-2), (III-9), (III-10), (III-17), (III-26), (III-29), (III-32), are commercially available compounds. Representative methods of preparing other compounds of the general formulas (II) and (III) which are not commercially available are either described in the literature or are described below.

More specifically, Compounds (III-4), (III-7) and (III-8) are described in J. Teppema and L. B. Sebrell, *J. Am. Chem. Soc.*, Vol. 49, 1748 to 1758 (1927) and ibid., Vol. 49, 1779–1785 (1927), Compound (III-20) can be prepared as described in Guha and Guha, *J. Indian Chem. Soc.*, Vol. 4, 169, Compounds (III-30) and (III-31) can be prepared as described in F. G. Fisher and J. Roch, Ann., Vol. 572, 217 (1951), and Compound (III-33) is described in S. Gabriel and J. Colman, Ber., Vol. 32, 2922 (1899).

The synthesis of other examples of the compounds of the general formulas (II) and (III) is set forth specifically below.

Synthesis Example III

(Synthesis of Compound (III-11))

11.7 g of N-methyl-o-phenylenediamine hydrochloride, 9.1 g of carbon disulfide and an aqueous solution containing 7.2 g of sodium hydroxide and 20 ml of water were added to 150 ml of ethanol and the mixture was heated and refluxed for 4 hours. After cooling, a 3 N hydrochloric acid aqueous solution was added to the reaction mixture to make the reaction solution slightly acidic and, thereby, crystals were precipitated. After filtration, the crystals were recrystallized from a mixture of water and ethanol (70:30 by volume) to obtain 6 g of 2-mercapto-1-methylbenzimidazole (Compound (III-11)) having a melting point of 194° to 195° C. (yield: 67%).

Synthesis Example IV

(Synthesis of Compound (III-15))

A mixture of 2.6 g of 4-methoxy-o-phenylenediamine hydrochloride, 70 ml of ethanol, 15 ml of carbon disulfide and an aqueous solution containing 1.5 g of sodium hydroxide and 5 ml of water was refluxed for 4 hours. Then, the reaction mixture was condensed under reduced pressure. The residue was recrystallized from a mixture of water and methanol (70:30 by volume) to obtain 1.3 g of 2-mercapto-5-methoxybenzimidazole (Compound (III-15)) having a melting point of 254° to 255° C. (yield: 59%).

Compounds (III-12), (III-13), (III-14) and (III-16) can be prepared in a manner similar to that described in Synthesis Example IV above.

Synthesis Example V

(Synthesis of Compound (III-22))

5 ml of acetic anhydride was added to 5 g of 4-methylthiosemicarbazide. After an exothermic reaction, water was added to the reaction mixture and the resulting crystals were filtered. 20 ml of anisole was added to the crystals and the mixture was heated and refluxed for 30 minutes. After cooling, the precipitated crystals were filtered and recrystallized from water to obtain 1 g of 3-mercapto-4,5-dimethyl-1,2,4-triazole (Compound (III-22)) having a melting point of 208° to 209° C. (yield: 16%).

Compounds (III-23) and (III-24) can be prepared in a manner similar to that described in Synthesis Example V above.

Synthesis Example VI

(Synthesis of Compound (III-19))

13 g of hydrazine sulfate was dissolved in 6 ml of warm water and 20 g of potassium rhodanide was added thereto and the mixture was refluxed for 2 hours. After cooling, the precipitated crystals were filtered. To the crystals was added 10 times by weight of a 17% hydrochloric acid aqueous solution and the mixture was refluxed for 15 minutes. After cooling, the precipitated crystals were filtered and recrystallized from water to obtain 9.3 g of 5-amino-2-mercapto-1,3,4-thiadiazole (Compound (III-19)) having a melting point of 236° C. (yield: 70%).

In order to incorporate the compound represented by the general formula (II) or (III) in the light-sensitive material of this invention, the compound may be added to a photographic emulsion layer or incorporated in other nonlight-sensitive layers such as a protective layer, an intermediate layer, a filter layer or an antihalation layer. It is preferred to incorporate the compound represented by the general formula (II) or (III) in the silver halide photographic emulsion layer of the surface latent image type containing silver halide grains and a binder which are employed in this invention.

The compound of the general formula (II) or (III) can be present in an amount ranging from about $10^{-5}$ to about $10^{-1}$ mol, particularly from $10^{-4}$ to $10^{-2}$ mol, per mol of silver based on the silver halide present in the same area. However, it is desired to select the most suitable amount of the compound depending on the grain size of the silver halide emulsion, the halogen composition, the method and degree of chemical sensitization, the relation between the layer containing the compound and the photographic emulsion layer, the type of anti-fogging compound present, etc.

The method for selection is well known to those skilled in the art and it is easy for those skilled in the art to conduct such.

In order to incorporate the compound of the general formula (II) or (III) in a silver halide emulsion layer or other non-light-sensitive hydrophilic colloid layers, the compound is added to a photographic emulsion or a coating composition for a non-light-sensitive layer. The same method of addition as described above for the addition of the compound of the general formula (I) to a photographic emulsion can be used. That is, the compound of the general formula (II) or (III) is dissolved in a water-miscible organic solvent such as an alcohol (such as methanol or ethanol), an ester (such as ethyl acetate) or a ketone (such as acetone) or an aqueous solution thereof is formed in the case of a water-soluble compound, and then, the thus-prepared solution is added to a hydrophilic colloid solution. It is sometimes convenient for dissolution to form an alkaline aqueous solution or an acidic aqueous solution.

In adding the compound of the general formula (II) or (III) to the photographic emulsion, the addition may be performed at any of stages of from the beginning of chemical ripening to before coating, but preferably, the addition is after completing the chemical ripening. In particular, it is preferred to add the compound of the general formula (II) or (III) to a coating composition ready for coating.

The photographic emulsion used in this invention can be prepared using the methods described in, e.g., P. Grafkides, *Chimie et Physique Photographique,* Paul Montel, Paris (1967), G. F. Duffin, *Photographic Emulsion Chemistry,* The Focal Press, London (1966), V. L. Zelikman et al., *Making and Coating Photographic Emulsions,* The Focal Press, London (1964), etc. That is, any of the acid method, the neutral method, the ammonia method and other methods can be used. Moreover, the reaction of a soluble silver salt with a soluble halogen salt can be made using any of the single jet method, the double jet method and a combination thereof.

The method in which grains are formed in the presence of an excess of silver ions (the so-called reverse mixing method) can also be used. As one of the modes of the double jet method, the method in which the pAg of the liquid phase in which the silver halide is to be produced is kept constant, that is, the so-called controlled double jet method, can be used. This method can provide silver halide emulsions having a regular crystal form and an almost uniform grain size.

The silver halide grains in the photographic emulsion used in this invention can have a relatively wide grain size distribution, but a narrow grain size distribution is preferred. In particular, the size of the silver halide grains amounting to 90% of the total, based on the weight or number of the grains, is preferably within ±40% of the average grain size (such an emulsion is usually called a monodispersed emulsion).

The silver halide grains in the photographic emulsion may be regular crystals such as cubic crystals or octahedral crystals, or irregular crystals such as spherical crystals or plate crystals, or may have a composite crystal form of these crystal forms. The grains may comprise mixed grains having various crystal forms.

The interior and the surface layer of the silver halide grain may be different or the grains may be uniform throughout.

In the process of the formation of silver halide grains or physical ripening, cadmium salts, zinc salts, lead salts, thallium salts, rhodium salts or complex salts thereof, iron salts or iron complex salts, and the like can be present.

Two or more of silver halide emulsions which are separately prepared can be mixed and then used, if desired.

After the formation of the precipitates or after physical ripening, the soluble salts are usually removed from the emulsion. For this purpose, the noodle washing method long well known in which gelatin is subjected to gelation may be used. Furthermore, the flocculation method which employs an inorganic salt having a polyvalent anion such as sodium sulfate, an anionic surface active agent, an anionic polymer (such as polystyrene sulfonic acid) or a gelatin derivative (such as an aliphatic acylated gelatin, an aromatic acylated gelatin or an aromatic carbamoylated gelatin) may be used. The removal of the soluble salts may be omitted, if desired.

Emulsions which are not chemically sensitized (the so-called primitive emulsions) can be used as the silver halide emulsion, but usually, the emulsion is chemically sensitized. For chemical sensitization, sulfur sensitization which uses a compound containing sulfur capable of reacting with silver ions or an active gelatin is preferred, but it can be used in combination with noble metal sensitization which uses a noble metal compound other than gold compounds. For noble metal sensitization, complex salts of the Group VIII metals such as platinum, iridium or palladium can be used, and specific examples of these salts are described in, e.g., U.S. Pat. No. 2,448,060, British Pat. No. 618,061, etc.

The silver halide emulsion layers or other hydrophilic colloid layers in the light-sensitive material of this invention can contain an anti-fogging agent other than the compounds represented by the general formula (II) or (III). For example, 1,2,3-triazole compounds (particularly benzotriazoles), benzothiazolium compounds, benzimidazoles, 4-hydroxy-1,3a,7-triazaindenes, 4-hydroxy-1,3,3a,7-tetrazaindenes, etc., can be employed. 4-hydroxy-1,3,3a,7-tetrazaindenes are particularly useful.

The effect of this invention is enhanced even more by adding a small amount of an iodide (such as potassium iodide) to the emulsion after the formation of the grains, before chemical ripening, after chemical ripening or before coating. A suitable amount of the iodide added ranges from about $10^{-4}$ to about $10^{-2}$ mol/mol Ag.

The photographic emulsions used in this invention can be spectrally sensitized with methine or other dyes. Suitable sensitizing dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. These dyes can contain, as a basic heterocyclic nucleus, any of the nuclei which are usually employed in cyanine dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus and the like; these above-described nuclei condensed with an alicyclic hydrocarbon ring; and these above-described nuclei condensed with an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus can be present. The carbon atoms of the above-described nuclei may be substituted.

The merocyanine dyes or complex merocyanine dyes can contain, as a nucleus having a ketomethylene structure, a 5- to 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus.

Useful sensitizing dyes are those described in, e.g., German Pat. No. 929,080, U.S. Pat. Nos. 2,231,658, 2,493,748, 2,503,776, 2,519,001, 2,912,329, 3,656,959, 3,672,897 and 3,694,217, British Pat. No. 1,242,588, Japanese Patent Publication No. 14,030/69, etc.

These sensitizing dyes may be used individually or as a combination thereof. A combination of sensitizing dyes is often employed particularly for the purpose of supersensitization. Typical examples of such combinations are described in, e.g., U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Pat. No. 1,344,281, Japanese Patent Publication No. 4,936/68, etc.

The sensitizing dyes may be present in the emulsion together with dyes which themselves have no spectrally sensitizing effects but exhibit a supersensitizing effect or materials which do not substantially absorb visible light but exhibit a supersensitizing effect. For example, aminostilbene compounds substituted with a nitrogen-containing heterocyclic ring group (e.g., those described in U.S. Pat. Nos. 2,933,390 and 3,635,721), aromatic organic acid-formaldehyde condensates (e.g., those described in U.S. Pat. No. 3,743,510), azaindene compounds, and the like, can be present. The combinations described in U.S. Pat. Nos. 3,615,613, 3,615,641, 3,617,295 and 3,635,721 are particularly useful.

A water-soluble dye may be present in any of the hydro philic colloid layers in the photographic light-sensitive material of this invention as a filter dye or for prevention of light scattering, antihalation or various other purposes. Examples of these dyes include oxonol dyes, hemioxonol dyes, styryl dyes, merocyanine dyes, cyanine dyes and azo dyes. Of them, oxonol dyes, hemioxonol dyes and merocyanine dyes are particularly useful. Specific examples of dyes which can be used are those described in British Pat. Nos. 584,609 and 1,177,429, Japanese Patent Application (OPI) Nos. 85,130/73, 99,620/74 and 114,420/74, and U.S. Pat. Nos. 2,274,782, 2,533,472, 2,956,879, 3,148,187, 3,177,078, 3,247,127, 3,540,887, 3,575,704, 3,653,905 and 3,718,472.

An inorganic or organic hardener may be present in any of the hydrophilic colloid layers in the light-sensitive material of this invention. For example, chromium salts (such as chrome alum or chromium acetate), aldehydes (such as formaldehyde, glyoxal or glutaraldehyde), N-methylol compounds (such as dimethylolurea or methyloldimethylhydantoin), dioxane derivatives (such as 2,3-dihydroxydioxane), active vinyl compounds (such as 1,3,5-triacryloyl-hexahydro-s-triazine or bis(vinylsulfonyl)methyl ether), active halogen compounds (such as 2,4-dichloro-6-hydroxy-s-triazine), mucohalic acids (such as mucochloric acid or mucophenoxychloric acid), isooxazoles, dialdehyde starch, 2-chloro-6-hydroxytriazinylated gelatin and the like can be used individually or in combination. Specific examples of these compounds are described in, e.g., U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,664 and 3,543,292, British Pat. Nos. 676,628, 825,544 and 1,270,578, German Pat. Nos. 872,153 and 1,090,427, Japanese Patent Publications Nos. 7,133/69 and 1,872/71, etc.

The light-sensitive material of this invention may contain various known surface active agents for various purposes, e.g., as a coating aid, for preventing the generation of static charges, improving slip characteristics, improving emulsion dispersion, preventing adhesion, improving photographic characteristics (e.g., accelerating development, increasing contrast, sensitizing), etc.

For example, nonionic surface active agents such as saponin (steroids), alkylene oxide derivatives (such as polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamines or amides or siliconepolyethylene oxide adducts), glycidol derivatives (such as alkenylsuccinic acid polyglycerides or alkylphenol polyglycerides), aliphatic esters of polyvalent alcohols, alkyl esters of sucrose, urethanes or ethers; anionic surface active agents containing an acidic group such as a carboxy group, a sulfo group, a phospho group, a sulfuric ester group or a phosphoric ester group, such as triterpenoid type saponin, alkylcarboxylates (salts), alkylsulfonates (salts), alkylbenzenesulfonates (salts), alkylnaphthalenesulfonates (salts), alkylsulfates, alkylphosphates, N-acyl-N-alkyltaurines, sulfosuccinates, sulfoalkylpolyoxyethylene alkylphenyl ethers or polyoxyethylene alkylphosphates; amphoteric surface active agents such as amino acids, aminoalkylsulfonic acids, aminoalkylsulfuric esters, aminoalkylphosphoric esters, alkylbetaines, amineimides or amine oxides; and cationic surface active agents such as alkylamine salts, aliphatic or aromatic quaternary ammonium salts, (such as pyridinium or imidazolium salts) or phosphonium or sulfonium salts containing an aliphatic or heterocyclic ring can be used.

Specific examples of these surface active agents are those described in, e.g., U.S. Pat. Nos. 2,240,472, 2,831,766, 3,158,484, 3,210,191, 3,294,540 and 3,507,660, British Pat. Nos. 1,012,495, 1,022,878, 1,179,290 and 1,198,450, Japanese Patent Application (OPI) No. 117,414/75, U.S. Pat. Nos. 2,739,891, 2,823,123, 3,068,101, 3,415,649, 3,666,478 and 3,756,828, British Pat. no. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Patent Publications Nos. 378/65, 379/65 and 13,822/68, U.S. Pat. Nos. 2,271,623, 2,288,226, 2,944,900, 3,253,919, 3,671,247, 3,772,021, 3,589,906 and 3,754,924, German Patent Application (OLS) No. 1,961,638, Japanese Patent Application (OPI) No. 59,025/75, etc.

The photographic emulsion of this invention can contain a dispersion of a synthetic polymer which is insoluble or slightly soluble in water for the purpose of improving the dimensional stability, or other purposes. Examples of polymers which can be used include polymers composed of one or more of an alkyl acrylate or methacrylate, alkoxyalkyl acrylate or methacrylate, glycidyl acrylate or methacrylate, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylate or methacrylate or styrenesulfonic acid, etc. For example, those compounds described in U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373 can be used. A suitable amount of the polymer ranges from about 20 to 80% by weight based on the total weight of the binders. Since contrasty emulsions such as that of this invention are suitable for the reproduction of line drawings and the dimensional stability is of importance for such a purpose, it is preferred for the above-described polymer dispersion to be employed.

In the case of color photographic light-sensitive materials, all ketomethylene yellow dye-forming couplers can advantageously be used. Typical examples thereof are couplers of the benzoylacetanilide series, pivalylacetanilide series, etc. Further, all magenta dye-forming couplers of the pyrazolone series, indazolone series, etc., can advantageously be used. In addition, all cyan dye-forming couplers of the phenol series, naphthol series, etc., can advantageously be used. These couplers may contain a coupling-off group at the active carbon atom positioned at the coupling site. Those couplers rendered nondiffusible with a ballast group are preferred. A large number of ballasted compounds are well known for these couplers.

These dye-forming couplers can be dispersed in a hydrophilic colloid in any known manner. They can advantageously be dispersed with the use of a coupler solvent as described in U.S. Pat. No. 2,322,027, etc.

The photographic emulsions are coated on conventional supports which do not undergo serious dimensional changes during processing. Typical supports which can be used are a cellulose acetate film, a polystyrene film, a polyethylene terephthalate film, a polycarbonate film, a laminate thereof, paper, baryta paper, paper coated or laminated with a hydrophobic polymer such as polyethylene, polypropylene, etc., as are commonly used for photographic light-sensitive materials. Transparent supports can be employed for certain end-uses of the light-sensitive material. Also, transparent supports may be colored by adding a dye or a pigment thereto as described in *J. SMPTE,* 67, 296 (1958), etc.

Where adhesion between the support and the photographic emulsion layer(s) is insufficient, a subbing layer (an adhesive layer adhesive to both the support and the photographic emulsion layer(s)) is employed. Also, in order to improve the adhesion, the surface of the support may be subjected to a preliminary processing such as a corona discharge, irradiation with ultraviolet light, flame treatment, etc. A suitable coating amount of silver is about 0.5 $g/m^2$ to about 10 $g/m^2$ of the support.

Exposure to light for obtaining a photographic image can be performed in a usual manner. Various known light sources such as natural light (sunlight), a tungsten lamp, a fluorescent light, a mercury lamp, a xenon arc lamp, a carbon arc lamp, a xenon flash lamp or a cathode ray tube flying spot can be used. The exposure time can, of course, be about 1/1,000 sec to about 1 sec which is usually employed with cameras, and further, exposure for shorter than about 1/1,000 sec, for example, about $1/10^4$ to about $1/10^6$ sec which is employed in case of using a xenon flash lamp or a cathode ray tube, and exposure for longer than about 1 sec can be employed. If desired, the spectral composition of the light used for the exposure can be controlled using a color filter. The fluorescence resulting from the excitation of a phosphor caused by ionizing radiation or a laser beam can also be used for exposure. Moreover, exposure to electron radiation, X-rays, $\gamma$-rays or $\alpha$-rays may be employed.

The photographic light-sensitive material of this invention can be photographically processed using known methods and known processing solutions. The processing temperature usually ranges from about 18° to about 50° C., but temperatures lower than about 18° C. or higher than about 50° C. may be used. This invention is useful for the formation of an image by development in which a silver image is formed (a black-and-white photographic processing). However, this invention is also applicable to color photographic processing comprising development in which a dye image is to be formed.

The developers used for black-and-white photographic processing preferably contain, as a developing agent, aminophenols (such as N-methyl-p-aminophenol), 3-pyrazolidones (such as 1-phenyl-3-pyrazolidone) or 1-phenyl-3-pyrazolines. The developers may further contain dihydroxybenzenes (such as hydroquinone), ascorbic acid, etc. Moreover, the developers usually contain a known antioxidant, an alkali agent, a pH buffer or the like and, if desired, a dissolving aid, a color toning agent, a development accelerator, a surface active agent, an anti-foaming agent, a water softener, a hardener, a tackifier, etc., may be present. An anti-fogging agent (such as an alkali metal halide or benzotriazole) may be present in the developer.

Color developers commonly used in the art can also be used in the present invention, i.e., any alkaline aqueous solution containing a color-developing agent. All known dye-forming aromatic primary amine developers such as phenylenediamines (e.g., N,N-diethyl-p-phenylenediamine, N-ethyl-N-hydroxyethyl-p-phenylenediamine, N-ethyl-N-hydroxyethyl-2-methyl-p-phenylenediamine, N-ethyl-$\beta$-N-methanesulfonamidoethyl-3-methyl-4-aminoaniline, N,N-diethyl-2-methyl-p-phenylenediamine, and the sulfonates, hydrochlorides and sulfites thereof, etc.) can be used as the color-developing agents. The color developer may further contain generally used additives such as a sulfite, carbonate, bisulfite, bromides or iodides of an alkali metal, benzyl alcohol and the like.

According to this invention, even when development is carried out using a developer containing more than about 0.15 mol/l of sulfite ions, a $\gamma$ of more than 8 can be obtained. The pH of the developer is preferably about 11 to about 12.3. If the pH exceeds about 12.3, the developer is unstable even when a high concentration of sulfite ions is present, and it is difficult to maintain stable photographic characteristics for more than 3 days under usual use conditions.

Those fixing solutions having a composition generally employed in the art can be used in the present invention. Not only thiosulfates and thiocyanates but also organic sulfur compounds known as fixing agents can be used as fixing agents in the present invention.

Suitable preferred examples of fixing agents which can be used in the fixing solution include water-soluble thiosulfates such as sodium thiosulfate, potassium thiosulfate, ammonium thiosulfate, etc., water-soluble thiocyanates such as sodium thiocyanate, potassium thiocyanate, ammonium thiocyanate, etc., water-soluble organic diol fixing agents containing an oxygen atom or a sulfur atom such as 3-thia-1,5-pentanediol, 3,6-dithia-1,8-octanediol, 9-oxa-3,6,12,15-tetrathia-1,17-heptadecanediol, etc., water-soluble sulfur containing organic dibasic acids and water-soluble salts thereof such as ethylenebisthioglycollic acid and the sodium salt thereof, etc., imidazolidinethiones such as methylimidazolidinethione, etc. Further, the fixing agents described in L. F. A. Mason, *Photographic Processing Chemistry,* pages 187 to 188, Focal Press (1966) are also preferred.

Other processing solutions, e.g., a bleaching solution, a fixing solution, a stabilizing solution, etc., known in the art also may advantageously be used. These processing solutions may be used in combination, e.g., as a bleach-fixing solution, a fix-stabilizing solution or a bleach-fix-stabilizing solution.

Such solutions are well known in the art, and any of such known solutions are useful. A bleaching solution contains a silver oxidizing agent(s), e.g., water-soluble ferricyanides, a simple water-soluble ferric, cupric or cobaltic salt, and complex salts of an alkali metal and polyvalent cations with an organic acid. Typical examples of polyvalent cations are ferric ions, cobaltic ions, cupric ions, etc. Typical examples of the organic acids are ethylenediaminetetraacetic acid, nitrilotriacetic acid, etc.

The following examples are given to illustrate the present invention in more detail.

EXAMPLE 1

To a gelatin aqueous solution kept at 50° C., an aqueous solution of silver nitrate and an aqueous solution of potassium bromide were simultaneously added over a 50 minute period while the pAg was kept at 7.9, thus preparing a silver bromide emulsion having an average grain size of 0.25μ. The soluble salts were removed from the emulsion in a conventional manner. Then, 43 mg of sodium thiosulfate was added per mol of silver bromide, and chemical ripening was conducted at 60° C. for 60 minutes. This emulsion contained 120 g of gelatin per mol of silver bromide. The internal sensitivity of this emulsion was negligibly small as compared with the surface sensitivity.

To this silver bromide emulsion, Compound (I-2) of this invention and a compound of the general formula (II) or (III) as an antifoggant were added as shown in Table 1 below and, further, 2-hydroxy-4,6-dichloro-1,3,5-triazine sodium salt was added as a hardener. Then, each of the thus-obtained emulsions were coated on a cellulose triacetate film at a silver coverage of 45 mg per 100 cm$^2$. Each sample was exposed through an optical wedge to light for 1 sec, then developed with a developer having the following composition at 20° C. for 3 minutes:

N-Methyl-p-aminophenol Hemisulfate: 5 g
Hydroquinone: 10 g
Sodium Sulfite (anhydrous): 75 g
Sodium Metaborate (tetrahydrate): 30 g
Potassium Hydroxide: 12 g
Water to make: 1 l (pH=11.5)

and then subjected to a stopping (20° C., 30 sec) and a fixing (20° C., 5 min) followed by washing and drying.

The photographic characteristics obtained are shown in Table 1 below. In Table 1, the relative sensitivity is expressed by the relative value of the reciprocal of the exposure amount required to provide a density of 2.0+fog, and in this case, the sensitivity of the Sample 1 is taken as 100.

Table 1

| Run No. | Compound (I-2) Amount Added (mol/mol Ag) | Antifoggant Compound | Antifoggant Amount Added (mol/mol Ag) | Photographic Characteristics Fog | Relative Sensitivity | γ |
|---|---|---|---|---|---|---|
| 1 | — | — | — | 0.46 | 100 | 6 |
| 2 | $2.1 \times 10^{-2}$ | — | — | 0.54 | 214 | 16 |
| 3 | " | III-24 | $1 \times 10^{-3}$ | 0.05 | 270 | >20* |
| 4 | " | " | $4 \times 10^{-3}$ | 0.04 | 250 | >20* |
| 5 | " | III-10 | $1.5 \times 10^{-3}$ | 0.07 | 148 | 18 |
| 6 | " | " | $4.5 \times 10^{-3}$ | 0.07 | 155 | >20* |
| 7 | " | III-2 | $0.9 \times 10^{-3}$ | 0.15 | 220 | 18 |
| 8 | " | " | $1.5 \times 10^{-3}$ | 0.10 | 224 | >20* |
| 9 | " | III-20 | $1.5 \times 10^{-3}$ | 0.11 | 224 | >20* |
| 10 | " | " | $4.5 \times 10^{-3}$ | 0.06 | 186 | >20* |
| 11 | " | III-26 | $3.5 \times 10^{-4}$ | 0.18 | 195 | 18 |
| 12 | " | " | $1.2 \times 10^{-3}$ | 0.05 | 230 | >20* |
| 13 | " | II-2 | $3.5 \times 10^{-4}$ | 0.20 | 191 | 18 |
| 14 | " | " | $1.2 \times 10^{-3}$ | 0.09 | 174 | 18 |
| 15 | " | III-30 | $3.5 \times 10^{-4}$ | 0.11 | 200 | 16 |
| 16 | " | " | $1.2 \times 10^{-3}$ | 0.09 | 166 | 17 |
| 17 | " | " | $1.9 \times 10^{-3}$ | 0.08 | 151 | 17 |
| 18 | " | III-31 | $3.5 \times 10^{-4}$ | 0.08 | 195 | 19 |
| 19 | " | " | $1.2 \times 10^{-3}$ | 0.06 | 158 | 19 |
| 20 | " | " | $1.9 \times 10^{-3}$ | 0.03 | 135 | 18 |

*A γ value exceeding 20 cannot be measured using a densitometer.

It is apparent from the results in Table 1 above that according to this invention, a stable developer having a pH of 11.5 can be used to obtain a γ of more than 10 and a high sensitivity, and further, less fog is produced.

EXAMPLE 2

Three types of silver halide emulsions A, B and C, each having an average grain size of 0.25μ and containing 120 g of gelatin per mol of silver were prepared.

Emulsion A: The same silver bromide emulsion as described in Example 1.

Emulsion B: A silver iodobromide emulsion containing 2 mol% of silver iodide which was prepared in the same manner as described in Example 1 except for adding potassium iodide in an amount corresponding to 2 mol% to the potassium bromide aqueous solution used for the reaction.

Emulsion C: An emulsion was prepared in the same manner as described in Example 1 except for adding a silver nitrate aqueous solution and a mixed aqueous solution of potassium bromide and sodium chloride to the gelatin aqueous solution. Sodium chloride was used in an amount corresponding to 20 mol% based on the amount of silver nitrate.

Emulsions A, B and C were respectively desalted and subjected to chemical ripening. Then, Compound (I-2), Compound (III-24) were added in the amounts shown in Table 2 below, and further, a hardener was added thereto. Thereafter, coating, exposure and processing were effected in the same manner as described in Example 1, and then, the photographic characteristics were determined. The results obtained are shown in Table 2 below.

Table 2

| Run No. | Emulsion | Compound (I-2) Amount Added (mol/mol Ag) | Compound (III-24) Amount Added (mol/mol Ag) | Photographic Characteristics Relative Sensitivity | γ | Fog |
|---|---|---|---|---|---|---|
| 1 | A | — | — | 100 | 6 | 0.46 |
| 2 | " | $2.1 \times 10^{-2}$ | — | 214 | 16 | 0.54 |

Table 2-continued

| Run No. | Emulsion | Compound (I-2) Amount Added (mol/mol Ag) | Compound (III-24) Amount Added (mol/mol Ag) | Photographic Characteristics Relative Sensitivity | γ | Fog |
|---|---|---|---|---|---|---|
| 3 | " | " | $1 \times 10^{-3}$ | 270 | 20< | 0.05 |
| 4 | " | " | $4 \times 10^{-3}$ | 250 | 20< | 0.04 |
| 5 | B | — | — | 100 | 5.5 | 0.63 |
| 6 | " | $1.9 \times 10^{-2}$ | — | 152 | 14 | 0.77 |
| 7 | " | " | $0.6 \times 10^{-3}$ | 195 | 20< | 0.15 |
| 8 | " | " | $2.5 \times 10^{-3}$ | 159 | 18 | 0.04 |
| 9 | C | — | — | 100 | 5 | 0.56 |
| 10 | " | $2.9 \times 10^{-2}$ | — | 172 | 16 | 0.61 |
| 11 | " | " | $1.0 \times 10^{-3}$ | 138 | 18 | 0.16 |
| 12 | " | " | $3.9 \times 10^{-3}$ | 122 | 18 | 0.04 |

The relative sensitivity is the same as defined in Example 1.

As is apparent from the results in Table 2 above, the light-sensitive materials of this invention, that is, Samples 3, 4, 7, 8, 11 and 12, exhibited a γ of much higher values and higher sensitivity than those of the samples containing neither Compound (I-2) nor Compound (III-24). Even in comparison with samples containing only Compound (I-2) (Samples 2, 6 and 10), the γ is increased more by the use of Compound (III-24), and in some cases (Emulsions A and B), the sensitivity is also increased more. It is an unexpectedly surprising effect that the anti-foggant which is generally known to decrease fog while reducing sensitivity and softening the contrast provides an increase in gradation and sensitivity. (Refer to Reference Example given hereinafter.)

EXAMPLE 3

Light-sensitive film samples were prepared in the same manner as in Run No. 3 of Example 1 except for using Compound (I-1), (I-4) or (I-7) in the amount shown in Table 3 below in place of Compound (I-2) and using Compound (III-24) in an amount of $2.8 \times 10^{-3}$ mol/mol Ag. In addition, samples which were the same as described above except for the omission of Compound (III-24) were prepared.

The thus-obtained samples were exposed through an optical wedge to light for 1 sec, then developed with a developer having the following composition at 20° C. for 3 minutes:

N-Methyl-p-aminophenol Hemisulfate: 5 g
Hydroquinone: 10 g
Sodium Sulfite (anhydrous): 75 g
Sodium Metaborate (tetrahydrae): 30 g
Potassium Hydroxide: 15 g
Water to make: 1 l (pH=12.0)

and then stopped and fixed as described in Example 1.

The photographic characteristics obtained are shown in Table 3 below.

Table 3

| Compound of the General Formula (I) (mol/mol Ag) | | Compound of the General Formula (III) (mol/mol Ag) | | Photographic Characteristics Sensitivity | γ | Fog |
|---|---|---|---|---|---|---|
| — | — | — | — | 100 | 4 | 0.56 |
| (I-1) | $2.1 \times 10^{-2}$ | (III-24) | — | 330 | 16 | 0.56 |
| " | " | " | $2.8 \times 10^{-3}$ | 330 | 15 | 0.04 |
| (I-4) | $1.7 \times 10^{-2}$ | (III-24) | — | 280 | >20 | 0.56 |
| " | " | " | $2.8 \times 10^{-3}$ | 260 | 19 | 0.04 |
| (I-7) | $1 \times 10^{-2}$ | (III-24) | — | 250 | 12 | 0.58 |
| " | " | " | $2.8 \times 10^{-3}$ | 230 | 12 | 0.04 |

As is apparent from the results in Table 3 above, also when Compound (I-1), (I-4) or (I-7) was used together with Compound (III-24), a stable developer having a pH of 12.0 can be used to provide high γ values of more than 10 and high sensitivity. Further, fog is remarkably decreased.

Reference Example

Samples as described in Example 1 were prepared in the same manner as described in Example 1 except for omitting Compound (I-2). The photographic characterisitics were determined in the same manner as in Example 1. The results obtained are shown in Table 4 below.

Table 4

| Run No. | Compound (II)/(III) Compound | Amount Added (mol/mol Ag) | Photographic Characteristics Relative Sensitivity | γ | Fog |
|---|---|---|---|---|---|
| 102 | — | — | 100 | 6 | 0.46 |
| 103 | III-24 | $1 \times 10^{-3}$ | 75 | 5 | 0.04 |
| 104 | " | $4 \times 10^{-3}$ | 62 | 5 | 0.04 |
| 105 | III-10 | $1.5 \times 10^{-3}$ | 83 | 5 | 0.06 |
| 106 | " | $4.5 \times 10^{-3}$ | 71 | 5 | 0.06 |
| 107 | III-2 | $0.9 \times 10^{-3}$ | 83 | 5.5 | 0.12 |
| 108 | " | $1.5 \times 10^{-3}$ | 43 | 4.5 | 0.08 |
| 109 | III-20 | $1.5 \times 10^{-3}$ | 100 | 6 | 0.09 |
| 110 | " | $4.5 \times 10^{-3}$ | 66 | 5.5 | 0.05 |
| 111 | III-26 | $3.5 \times 10^{-4}$ | 75 | 6 | 0.14 |
| 112 | " | $1.2 \times 10^{-3}$ | 97 | 6 | 0.04 |
| 113 | II-2 | $3.5 \times 10^{-4}$ | 98 | 5.5 | 0.16 |
| 114 | " | $1.2 \times 10^{-3}$ | 106 | 6 | 0.08 |
| 115 | III-30 | $3.5 \times 10^{-4}$ | 62 | 6 | 0.09 |
| 116 | " | $1.2 \times 10^{-3}$ | 62 | 6 | 0.08 |
| 117 | " | $1.9 \times 10^{-3}$ | 87 | 5 | 0.07 |
| 118 | III-31 | $3.5 \times 10^{-4}$ | 65 | 6 | 0.07 |
| 119 | " | $1.2 \times 10^{-3}$ | 44 | 6 | 0.05 |
| 120 | " | $1.9 \times 10^{-3}$ | 24 | 5.5 | 0.03 |

It is apparent from the results in Table 4 above that when Compound (I-2) is not employed, the use of the compound of the general formula (II) or (III) causes a marked reduction in sensitivity and a decrease in γ value.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material containing at least one negative image silver halide photographic emulsion layer comprising silver halide grains which have an average grain size of not more than about 0.7μ and which are substantially of the surface latent image type and containing a binder in an amount of not more than about 250 g per mol of silver halide and in which a compound represented by the following general formula (I):

$$R^1NHNHCOR^2 \quad (I)$$

wherein $R^1$ represents an aryl group; and $R^2$ represents a hydrogen atom, a phenyl group or an unsubstituted alkyl group having 1 to 3 carbon atoms; is present in at least one of the hydrophilic colloid layers, said compound of the formula (I) being present in an amount of about $10^{-4}$ to about $10^{-1}$ mol/mol Ag based on the silver halide grains of the surface latent image type, and a compound represented by the following general formula (II) or (III):

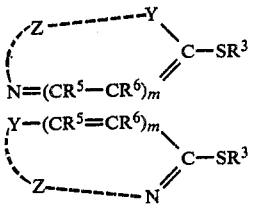

(II)

(III)

wherein Y represents a sulfur atom, a selenium atom, an oxygen atom, a nitrogen atom or a divalent residue: —$NR^4$—, wherein $R^4$ represents a hydrogen atom, an alkyl group or an aryl group; Z represents an atomic group required for completing a 5- or 6-membered heterocyclic ring; $R^5$ and $R^6$, which may be the same or different, each represents a hydrogen atom, a halogen atom, a carboxy group, an alkoxycarbonyl group, an alkyl group, an aryl group, a hydroxy group, a mercapto group or an alkylthio group or $R^5$ and $R^6$ may combine and represent an atomic group required for forming a 5- or 6-membered ring; m is 0 or 1, with m being 0 where Y represents a sulfur atom, a selenium atom or an oxygen atom; and $R^3$ represents a hydrogen atom, an alkylthiocarbonyl group, an alkoxycarbonyl group, an aryloxycarbonyl group, an alkoxycarbonylmethyl group, an aryloxycarbonylmethyl group or a moiety represented by the formula:

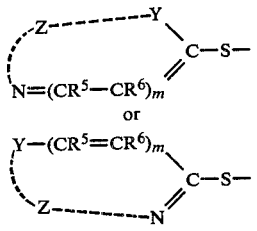

wherein Y, Z, $R^5$, $R^6$ and m are as described above; is present in the same or a different hydrophilic colloid layer.

2. The light-sensitive material as claimed in claim 1, wherein the compound represented by the general formula (II) or (III) is present in at least one negative image silver halide photographic emulsion layer comprising silver halide grains which have an average grain size of not more than about 0.7μ and which are substantially of the surface latent image type and containing a binder in an amount of not more than about 250 g per mol of silver halide, and the compound represented by the general formula (I) is present in the same layer as said compound represented by the general formula (II) or (III) or in a different hydrophilic colloid layer.

3. The light-sensitive material as claimed in claim 1, wherein the negative image silver halide emulsion layers comprising silver halide grains which have an average grain size of not more than about 0.7μ and which are substantially of the surface latent image type and containing a binder in an amount of not more than about 250 g per mol of silver halide are sulfur-sensitized and are not substantially gold-sensitized.

4. The light-sensitive material as claimed in claim 1, wherein both the compound represented by the general formula (I) and the compound represented by the general formula (II) or (III) are present in each of the negative image silver halide emulsion layers comprising silver halide grains which have an average grain size of not more than about 0.7μ and which are substantially of the surface latent image type and containing a binder in an amount of not more than about 250 g per mol of silver halide.

5. The light-sensitive material as claimed in claim 1, wherein the silver halide in the negative image silver halide photographic emulsion layers that are of the surface latent image type is silver chlorobromide containing not more than about 80 mol% of silver chloride, silver iodobromide containing not more than about 10 mol% of silver iodide, silver iodochlorobromide containing not more than about 80 mol% of silver chloride and not more than about 10 mol% of silver iodide, or silver bromide.

6. The light-sensitive material as claimed in claim 1, wherein the silver halide in the negative image silver halide photographic emulsion layers that are of the surface latent image type is silver bromide, silver chlorobromide containing not more than 50 mol% of silver chloride, silver iodobromide containing not more than 6 mol% of silver iodide or silver iodochlorobromide containing not more than 50 mol% of silver chloride and not more than 6 mol% of silver iodide.

7. The light-sensitive material as claimed in claim 1, wherein the compound represented by the general formula (I) is a compound represented by the following general formula (Ia):

$R^1NHNHCHO$ (Ia)

wherein $R^1$ represents an aryl grup.

8. The light-sensitive material as claimed in claim 1, wherein the compound represented by the general formula (II) or (III) is one of the compounds represented by the general formulas (IV-a) to (IV-p):

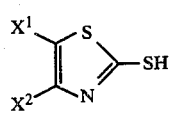

(IV-a)

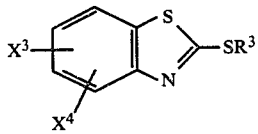

(IV-b)

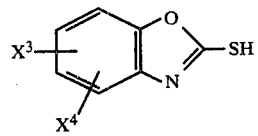

(IV-c)

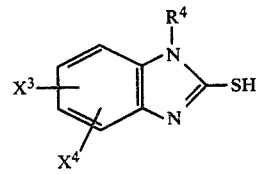

(IV-d)

-continued (IV-e)

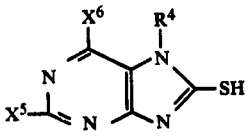

(IV-f)

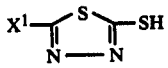

(IV-g)

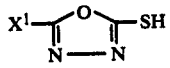

(IV-h)

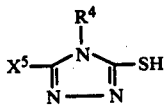

(IV-i)

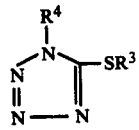

(IV-j)

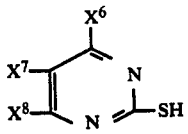

(IV-k)

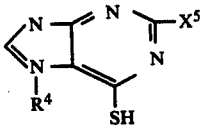

(IV-l)

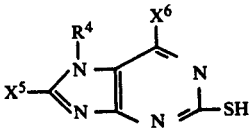

(IV-m)

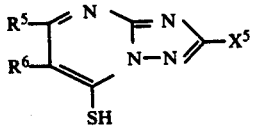

(IV-n)

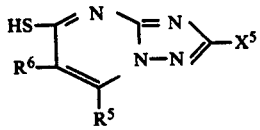

(IV-o)

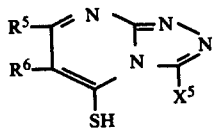

or (IV-p)

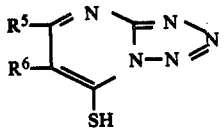

wherein $R^3$, $R^4$, $R^5$ and $R^6$ each has the same meaning as in the general formula (II); $X^1$ and $X^2$, which may be the same or different, each represents a hydrogen atom, an alkyl group, an alkoxy group, a hydroxy group, an alkylthio group, a mercapto group, an aryl group, a halogen atom, an alkoxycarbonyl group or an aryloxycarbonyl group; $X^3$ and $X^4$, which may be the same or different, each represents a hydrogen atom, an alkyl group, an alkoxy group, a hydroxy group, a halogen atom, an alkoxycarbonyl group, an aryloxycarbonyl group, an alkyl-substituted amino group, an aryl-substituted amino group, an acyl-substituted amino group, a cyano group or a carbamoyl group; and $X^5$, $X^6$, $X^7$ and $X^8$, which may be the same or different, each represents a hydrogen atom, an alkyl group, an alkoxy group, a hydroxy group, an alkylthio group, a mercapto group, an aryl group, an alkoxycarbonyl group, an aryloxycarbonyl group, an alkyl-substituted amino group, an aryl-substituted amino group, an acyl-substituted amino group, an amino group, an alkenyl group or a carboxyl group.

9. The light-sensitive material as claimed in claim 1, wherein all of the silver halide photographic emulsion layers are negative image silver halide photographic emulsion layers comprising silver halide grains which have an average grain size of not more than about 0.7$\mu$ and which are substantially of the surface latent image type and containing a binder in an amount of not more than about 250 g per mol of silver halide and each of the emulsion layers contains the compound represented by the general formula (II) or (III) and the compound represented by the general formula (I).

10. The light-sensitive material as claimed in claim 1, wherein the compound of the general formula (I) is a compound represented by the following general formula (Ib):

$$R^{11}NHNHCHO \qquad \text{(Ib)}$$

wherein $R^{11}$ represents a phenyl group or a tolyl group.

11. The light-sensitive material as claimed in claim 1, wherein the silver halide in the negative image silver halide emulsion layers that are of the surface latent image type is silver bromide or silver iodobromide containing not more than about 10 mol% of silver iodide.

* * * * *